US006007265A

United States Patent [19]

Whaley

[11] Patent Number: 6,007,265

[45] **Date of Patent: *Dec. 28, 1999**

[54] SPUR EYELET FASTENER WITH UNIFORM CIRCULAR BASE FOR SECURING RING BINDER MECHANISM

[75] Inventor: Paul Whaley, Herculaneum, Mo.

[73] Assignee: U.S. Ringbinder Corp., New Bedford, Mass.

[ * ] Notice: This patent is subject to a terminal disclaimer.

[21] Appl. No.: 09/168,635

[22] Filed: Oct. 8, 1998

Related U.S. Application Data

[63] Continuation of application No. 09/009,901, Jan. 20, 1998, Pat. No. 5,903,958.

[51] Int. Cl.[6] ..... B42F 3/04

[52] U.S. Cl. ..... 402/31; 402/75; 402/27; 402/14; 402/70

[58] Field of Search ..... 402/75, 27, 14

[56] References Cited

U.S. PATENT DOCUMENTS 534,023 2/1895 Vurgason .
5,100,253 3/1992 Cooper .
5,106,223 4/1992 Kraus ..... 403/11
5,160,209 11/1992 Schuessler .
5,755,513 5/1998 To .
5,842,807 12/1998 To .
5,903,958 5/1999 Whaley ..... 402/75

*Primary Examiner*—Willmon Fridie, Jr.
*Assistant Examiner*—Alisa Thurston
*Attorney, Agent, or Firm*—Polster, Lieder, Woodruff & Lucchesi, LC

[57] ABSTRACT

A fastener (30) for fastening a paper retaining binder mechanism (18) to the spine (16) of a binder (10) and remaining entirely concealed from an outer surface of the binder. The fastener includes a circular anchor plate (38) and a vertically extending attachment post or eyelet (34). The post is a truncated cone of uniform taper. The anchor plate includes a circumferential reinforcing lip (48). The fastener is secured to the spine by a number of spurs (50) uniformly spaced about the circumference of the anchor plate. The eyelet extends perpendicular of the anchor plate and the binder mechanism seats on the eyelet by an opening (26, 28). The upper end of the eyelet is then deformed about the opening to secure the binder mechanism in place.

17 Claims, 4 Drawing Sheets

SPUR EYELET FASTENER WITH UNIFORM CIRCULAR BASE FOR SECURING RING BINDER MECHANISM

CROSS-REFERENCE TO RELATED APPLICATIONS

This application is a continuation of Ser. No. 09/009,901 filed Jan. 20, 1998, U.S. Pat. No. 5,903,958 May 18, 1999.

STATEMENT REGARDING FEDERALLY SPONSORED RESEARCH OR DEVELOPMENT

Not Applicable.

BACKGROUND OF THE INVENTION

This invention relates to paper retaining ring binder mechanisms, and more particularly, to a spur eyelet having a uniform circular base for securing a ring metal of the ring binder mechanism to a spine portion of a binder.

Paper retaining ring binder mechanisms typically comprise a ring metal assembly, formed of metal, and including binder rings which are openable for the insertion and removal of material, such as hole-punched sheets of paper. The ring binders and a lever mechanism by which they are opened and closed all form part of the ring metal assembly. A plate covers the lever mechanism and usually includes provisions at each end for attachment of the ring metal to a spine section of the binder. One form of attachment includes the use of rivets secured to the binder and passing upward, through the ring metal. However, it has been found that other means of attachment are more secure and better able to withstand the rigors associated with daily binder use.

For cosmetic purposes, it is often desirable to incorporate a means for securing the ring binder mechanism to the binder which is not visible on the exterior surfaces of the binder. U.S. Pat. No. 5,755,513 to To, No. 5,160,209 to Schuessler, and No. 5,100,253 to Cooper each illustrate a fastener comprising an upright rivet structure mounted on a rectangular attachment plate and having a number of prongs adapted to grip an interior surface of a binder. The rivet structures in each of these patents are designed to pass through openings in the binder mechanism for attachment thereto.

While useful for their intended purpose, these fasteners suffer from several drawbacks. First, the prongs of each fastener are punched directly out of the attachment plate material; and, as best shown in FIG. 4A of the '513 patent, are surrounded by non-uniform amounts of material. This is due to the rectangular configuration of the attachment plate.

Second, the rectangular configuration further hinders automated assembly of the binders, as each fastener must be oriented such that the longest dimension of the attachment plate is properly oriented along the spine of the binder. Incorrect orientation will result in the interference between the cover portions and the attachment plate when the binder is folded closed.

Finally, the upright rivet structure commonly used in the prior art fasteners requires either a shoulder incorporated into the rivet structure itself, as is shown in the '513 patent, or a separate supporting means to hold the ring metal in position as the upper surface of the rivet is deformed to secure the ring metal, as is seen in the '209 and '253 patents.

BRIEF SUMMARY OF THE INVENTION

Among the several objects and advantages of the present invention are:

The provision of a spur eyelet fastener adapted for attachment to the spine of a binder irrespective of the orientation of the attachment plate;

The provision of the aforementioned spur eyelet fastener which is adapted for attachment to the spine of a binder such that no portion of the fastener is visible from the exterior of the binder;

The provision of the aforementioned spur eyelet fastener which supports the ring metal during attachment thereof; and The provision of the aforementioned spur eyelet fastener which is of unitary construction, facilitates automated assembly, and may be utilized with existing ring metals.

Briefly stated, the spur eyelet fastener of the present invention is adapted to secure a ring binder mechanism to a spine portion of a binder without being visible from the exterior of the binder. The spur eyelet fastener includes a circular attachment plate from which a number of inwardly radiating attachment prongs are formed, as well as a vertically oriented, deformable eyelet centrally disposed on the attachment plate. The circular attachment plate facilitates installation of the fastener by eliminating the need to orientate the fastener in relation to the binder spine prior to attachment thereto. The attachment prongs, integrally formed from the attachment plate, each include a number of barbs configured to grip the material of the binder spine when the fastener is attached. A circumferential lip surrounding the attachment plate reinforces the plate against any torsional flexing transferred through the ring metal and deformable eyelet when the ring binder mechanism is operated.

In the preferred embodiment, the deformable eyelet is formed as a hollow, truncated cone with a vertically decreasing diameter. The diameter of the eyelet, adjacent the truncated peak of the cone, is smaller than that of an opening formed in the ring metal through which the eyelet passes; however, the diameter of the eyelet base, adjacent the attachment plate, is significantly greater than that of the opening, such that the ring metal seats on the eyelet approximately midway along its vertical extent, at a point where the eyelet diameter exceeds the diameter of the opening. Once seated, the distal end of the eyelet is deformed over the ring binder, securing it in place.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF A PREFERRED EMBODIMENT

Figure 1A:
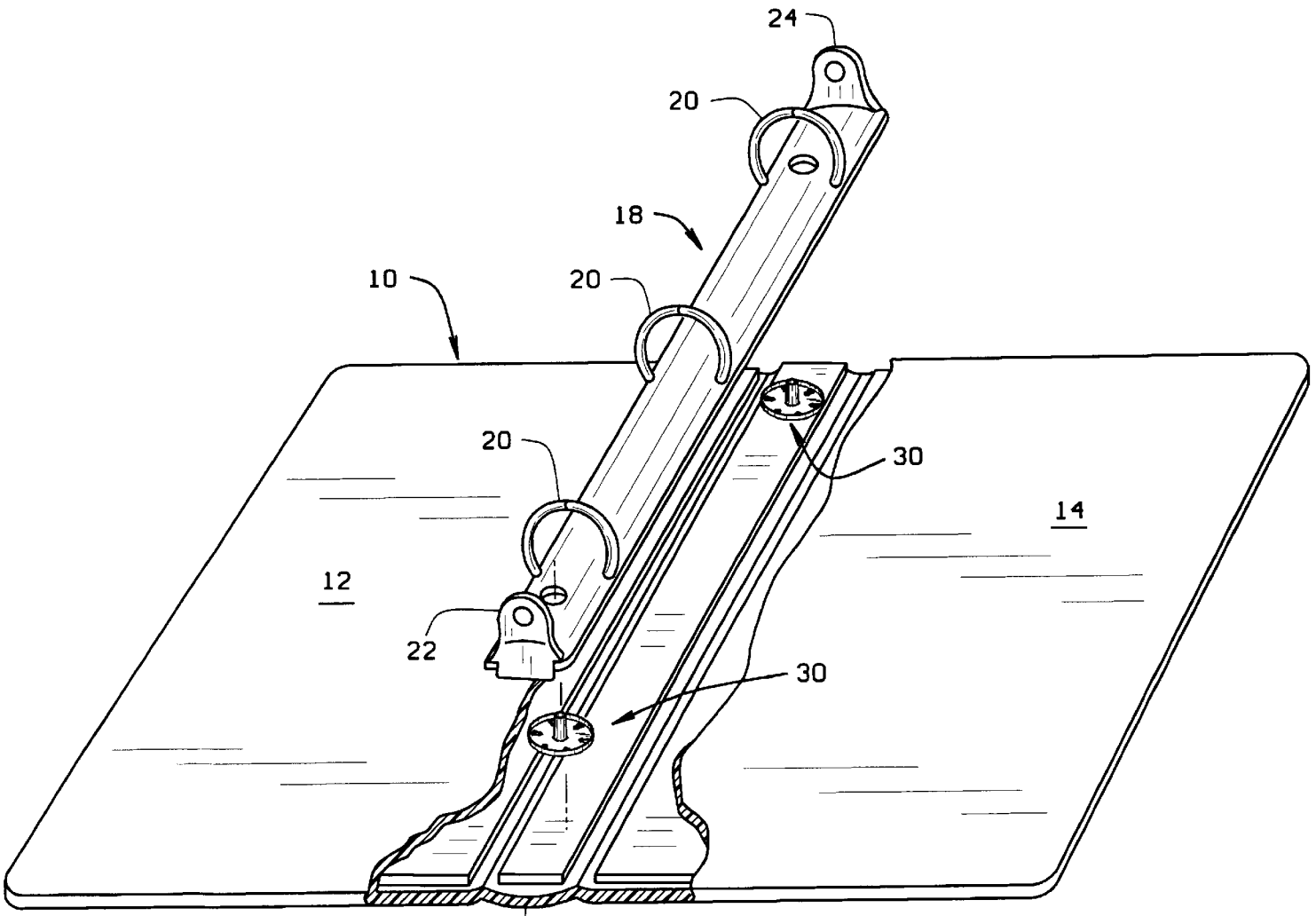
FIG. 1A is a exploded view of a ring binder mechanism, a pair of spur eyelet fasteners of the present invention, and a binder cover, illustrating the interaction of the components.

The following detailed description illustrates the invention by way of example and not by way of limitation. The description clearly enables one skilled in the art to make and use the invention, describes several embodiments, adaptations, variations, alternatives, and uses of the invention, including what we presently believe is the best mode of carrying out the invention.

Referring to the drawings, a binder 10 for holding hole punched sheet of paper (not shown) has side leaves 12 and 14, and a center spine section 16, intermediate the leaves. A ring metal binder mechanism 18, constructed as is well-known in the art, is attached to the spine. Incorporated in the ring metal binder are a plurality of binder rings 20, and mechanisms (not shown) for opening and closing the rings in response to movement of levers 22 and 24 at respective ends of the ring metal. Prior to the present invention, rivets (not shown) were typically used to secure the ring metal the binder spine through rivet openings 26 and 28 in the ring metal binder mechanism.

In accordance with the present invention, a spur eyelet fastener, indicated generally at 30 in FIGS. 1A–4, is usable to attach the ring metal binder mechanism 18 to the binder spine. As shown in FIG. 1A, an eyelet 32 on each fastener 30 is used for this purpose by being attached adjacent the respective longitudinal ends of the binder mechanism 18, through openings 26, 28. Additional fasteners 30 can also be used, if desired, these fasteners being located intermediate the ends of the binder mechanism 18 and having eyelets (not shown) passing through additional openings (also not shown).

Figure 1B:
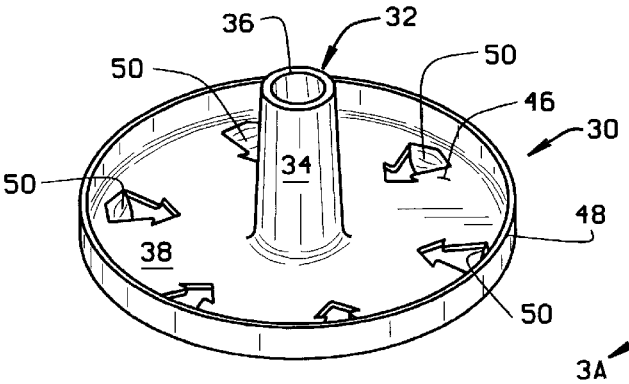
FIG. 1B is a perspective view of the spur eyelet fastener of the present invention, illustrating a conical eyelet and circular attachment base.
Figure 3A:
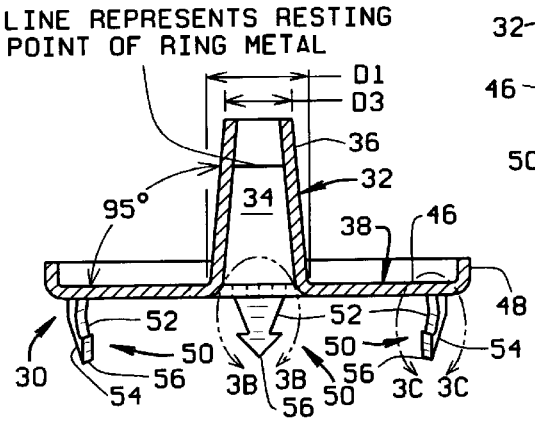
FIG. 3A is a side sectional view of the spur eyelet fastener of FIG. 2A, taken along line 3A—3A.
Figure 2B:
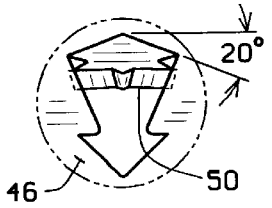
FIG. 2B is an enlarged top view of an attachment prong shown at 2B—2B in FIG. 2A.
Figure 3B:
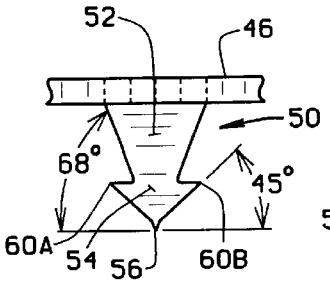
FIG. 3B is an enlarged front view of an attachment prong shown at 3B—3B in FIG. 3A.
Figure 4:
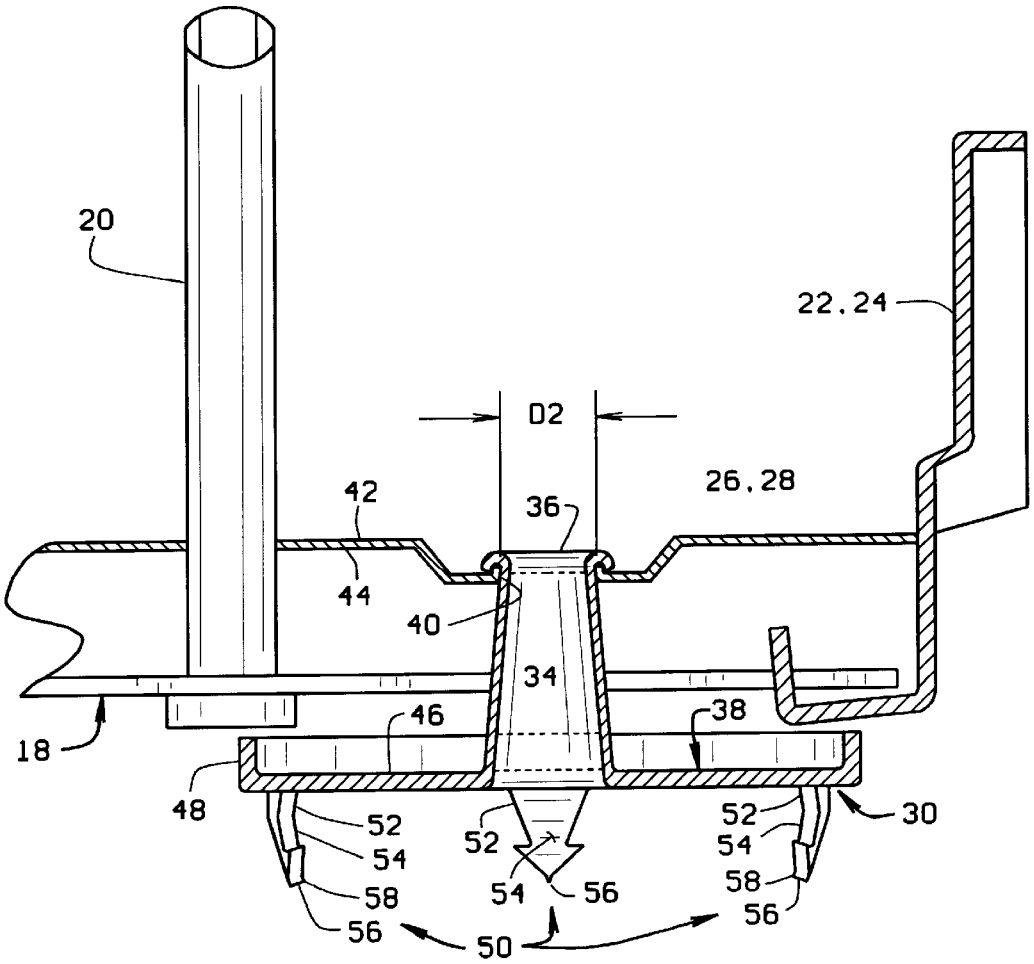
FIG. 4 is a longitudinal sectional view of the ring binder mechanism secured to the spur eyelet fastener.

Each eyelet 32 includes a hollow post 34 for attachment to the ring metal binder mechanism at an upper end 36. As shown in FIG. 1B, post 34 is integrally formed with a circular attachment base 38 of fastener 30. In the preferred embodiment, the diameter of the post decreases from its proximal portion adjacent attachment base 38 to the upper, distal end 36 of the post. The post thus forms a truncated conical, or frustoconical structure. As shown in FIG. 3A, the uniformly tapered outer surface of conically shaped post 34 creates an angle of 95° with respect to base 38. Thus, the post angles inwardly 5° with respect to the vertical axis of the fastener. The diameter D1 at the proximal end of the post, where it attaches to base 38, is significantly greater than the diameter D2 of openings 26 and 28 in the ring binder mechanism 18, and smaller than diameter D3 at the upper, distal end of the post. As best seen in FIG. 4, when attached to ring metal binder mechanism 18, post 34 seats against an angled inner surface 40 of the opening at the circumferential point on post 34 where the diameter of the post becomes greater than diameter of the opening, thereby preventing further downward displacement of binder mechanism 18. In the preferred embodiment, angled inner surface 40 of the opening is formed with a 5° outward slope from an upper surface 42 to a lower surface 44 of binder mechanism 18, complimenting the 5° inward slope of post 34. One skilled in the art will recognize that conical post 34 can also be used with ring binder mechanisms (not shown) which do not include an angled inner surface 40. However, in such usages, the area of contact between inner surface 40 of each opening and the exterior surface of post 34 will be reduced. Once binder mechanism 18 is seated on post 34, upper end 36 of the eyelet is deformed, by rolling or pressing, against an upper surface 42 of binder mechanism 18, thereby securing the binder mechanism to the post.

Figure 2A:
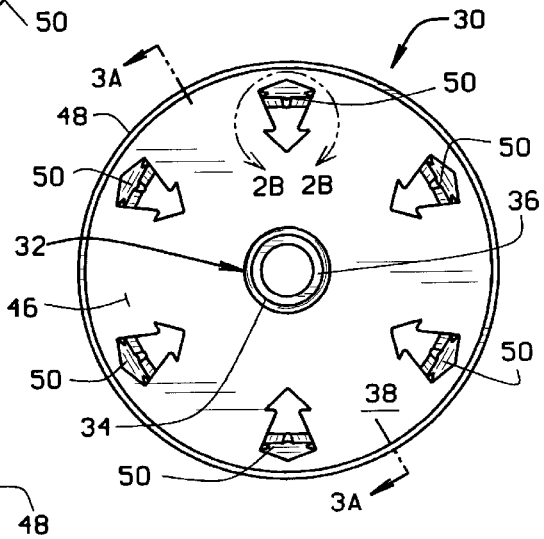
FIG. 2A is a top plan view of the spur eyelet fastener of FIG. 1A.
Figure 5:
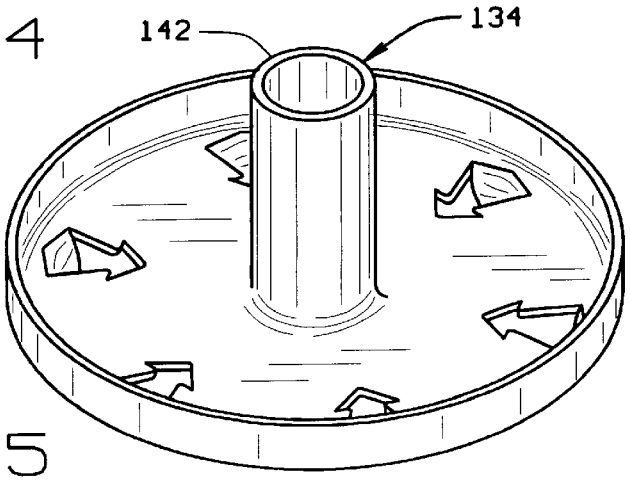
FIG. 5 is a perspective view of an alternate embodiment of the spur eyelet fastener of the present invention, illustrating a cylindrical eyelet and circular attachment base.

Fastener 30 is secured to center spine section 16 by circular attachment base 38. As shown in FIGS. 1B, 2A, and 5, the attachment base is circular, with a circular base plate 46 and a circumferential raised reinforcing lip 48. Eyelet 32 extends perpendicular to base plate 46 such that a longitudinal axis LP of post 34 is co-axial with the base plate. A plurality of spurs 50 are formed on base plate 46. These spurs are uniformly and concentrically spaced about the base plate, and project radially inwardly from the outer margin of the fastener defined by lip 48 toward post 34. In FIG. 2A, six spurs 50 are shown arranged approximately 60° apart. Those skilled in the art will recognize that the uniform concentric spacing of spurs 50 provides for a uniform amount of material between each spur and the perimeter edge of the base plate 46, and that the number of spurs 50 may be varied as needed, all within the scope of this invention.

Figure 3C:
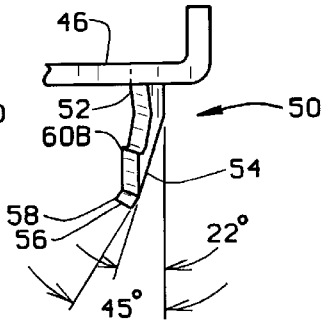
FIG. 3C is an enlarged side view of an attachment prong shown at 3C—3C in FIG. 3A.

The spurs 50, which are formed by a punching or stamping operation during manufacture of the fastener 30, project downward from the underside of base plate 46, and are comprised of two sections. As best seen in FIG. 3C, a first spur section 52 extends perpendicularly downward from base plate 46, and a second spur section 54 extends inwardly at an angle from section 52. This angle is preferably greater than 20°. Section 54 terminates in a tip 56 having a leading edge 58 angled inward an additional amount, preferably 2° from section 54, to produce a generally curved configuration to a spur 50. Additionally included on section 54 are a pair of barbs 60A, 60B, formed to grip core material 62 of center spine section 16 and prevent fastener 30 from being pulled away from the core material.

During assembly, each fastener 30 is secured to center spine section 16 by pushing spurs 50 into the spine core material 56. Leading edge 58 of tip 56 cuts into the spine core material and guides spur sections 52 and 54. Because the spurs have an inwardly angled section 54 and curved tip 56, each spur 50 deforms (i.e. flattens) as a result of the force applied to a fastener 30 to push it into the spine core material. The barbs 60A, 60B, grip the core material, resisting any force acting to pull fastener 30 away from center spine section 16. Next, as described above, ring metal binder section 18 is placed over the eyelets 32 of the respective fasteners and secured to the fasteners by deformation.

Figure 6:
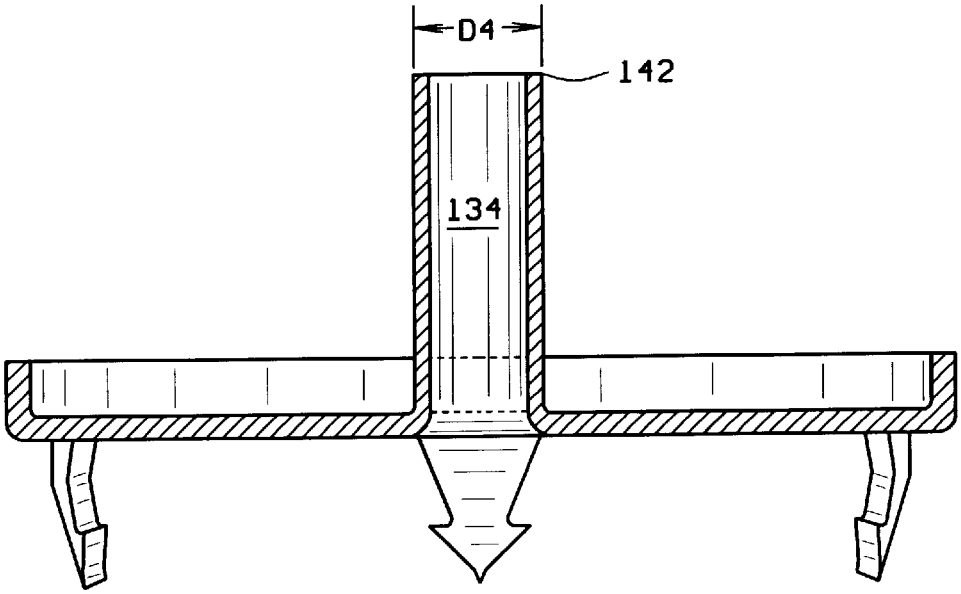
FIG. 6 is a side sectional view of the alternate embodiment shown in FIG. 5.
Figure 7:
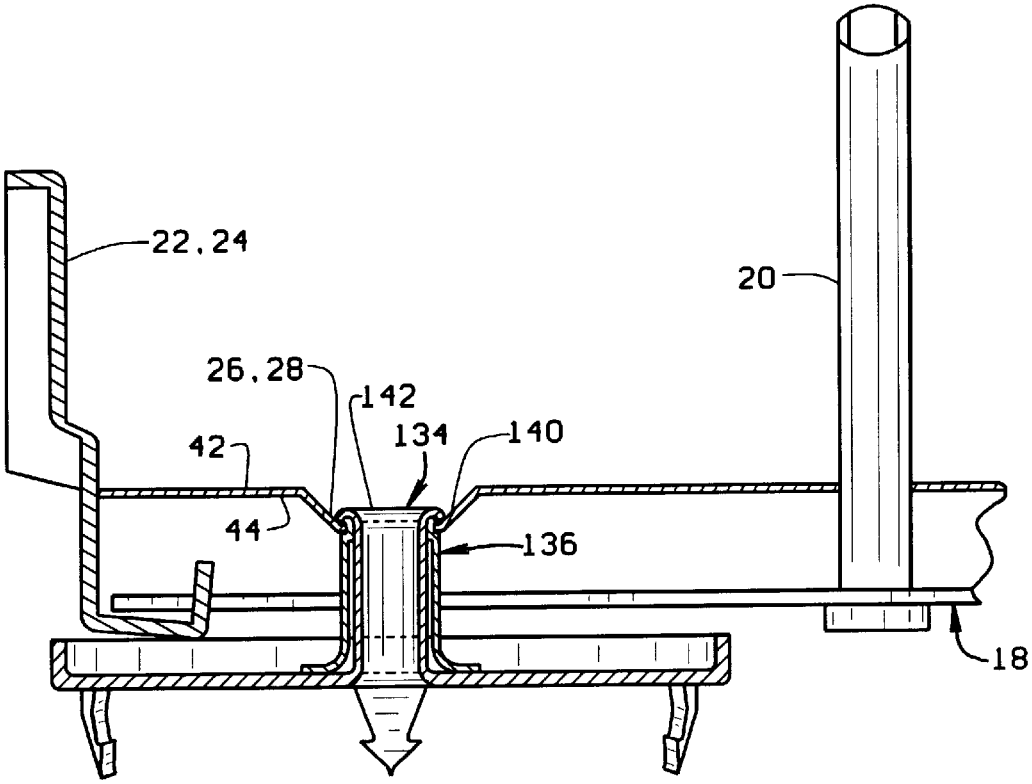
FIG. 7 is a longitudinal sectional view of the ring binder mechanism secured to the spur eyelet fastener shown in FIG. 5.

As shown in FIGS. 5–7, those skilled in the art will readily recognize that post 34 of fastener 30 may be available in a number of different configurations. For example, a cylindrical post 134 as shown in these drawing figures can be utilized. In this embodiment of the fastener, ring metal binder mechanism 18 does not seat against post 134 because as the outer diameter D4 of the post is less than the diameter of openings 26, 28. Now, a sleeve 136 or other cylindrical support structure having a diameter greater than that of openings 26, 28, and a height less than that of post 134 is inserted over the post to provide an upper edge surface 140 against which the ring metal binder mechanism 18 is seated. Once mechanism 18 is seated against upper edge surface 140, an upper end portion 142 of post 134 is deformed to secure the ring metal binder mechanism to the fastener. The base portion of the structure, and the spur constructure are similar to that of fastener 30 and will not be described.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

I claim:

1. A fastener for fastening a paper retaining binder mechanism to a binder comprising:

an anchor plate on which are formed a plurality of spurs for securing the fastener to a spine of the binder; and, an eyelet integrally formed with said anchor plate and projecting outwardly therefrom for an opening on said binder mechanism to be seated on said eyelet, said binder mechanism being secured to said fastener by deforming an end of said eyelet about said opening after said binder mechanism is in place;

said anchor plate being a circular plate with said spurs being uniformly spaced around the circumference thereof for engaging said spine to secure said fastener thereto, the circularity of said plate allowing said fastener to be placed in any orientation on said spine prior to securing said fastener to said spine without effecting the secureness of the fastener to the spine or the binder mechanism to the fastener.

2. The fastener of claim 1 wherein said eyelet comprises a hollow post.

3. The fastener of claim 2 wherein said post has a truncated cone shape with the proximal end of the post having a larger diameter than the distal end thereof.

4. The fastener of claim 3 wherein the post is uniformly tapered throughout its length.

5. The fastener of claim 4 wherein said opening in said binder mechanism has an angled inner surface which compliments the taper of said post thereby facilitating seating of said binder mechanism on said fastener.

6. The fastener of claim 2 wherein said post has a uniform diameter along its length.

7. The fastener of claim 6 further including a sleeve fitting over said post for mounting said binder mechanism to said fastener.

8. The fastener of claim 1 further including a circumferential rim extending about said anchor plate to reinforce said plate.

9. The fastener of claim 1 wherein each said spur includes a first spur section extending perpendicularly from said base plate, and a second spur section extending inwardly at an angle from said first spur section.

10. The fastener of claim 9 wherein said angle is greater than 20°.

11. The fastener of claim 9 wherein said second spur section terminates in a tip having an inwardly angling leading edge to produce a generally curved spur configuration.

12. A fastener for fastening a paper retaining binder mechanism to a binder comprising:

a circular anchor plate on which are formed a plurality of spurs for securing the fastener to a spine of the binder, said spurs being uniformly spaced about the circumference of said anchor plate for engaging said spine to secure said fastener thereto, the circularity of said plate enabling said fastener to be placed in any orientation on said spine prior to securing said fastener to said spine without effecting the secureness of the fastener to the spine; and, an eyelet integrally formed with said anchor plate and projecting outwardly therefrom for an opening on said binder mechanism to be seated on said eyelet, said eyelet comprising a hollow post having a truncated cone shape with the proximal end of the post having a larger diameter than the distal end thereof, said post being uniformly tapered throughout its length, and said binder mechanism being secured to said fastener by deforming an end of said eyelet about said opening after said binder mechanism is in place.

13. The fastener of claim 12 wherein said opening in said binder mechanism has an angled inner surface which compliments the taper of said post thereby facilitating seating of said binder mechanism on said fastener.

14. The fastener of claim 12 further including a circumferential rim extending about said anchor plate to reinforce said plate.

15. The fastener of claim 14 wherein each said spur includes a first spur section extending perpendicularly from said base plate, and a second spur section extending inwardly at an angle from said first spur section.

16. The fastener of claim 15 wherein said angle is greater than 20°.

17. The fastener of claim 16 wherein said second spur section terminates in a tip having an inwardly angling leading edge to produce a generally curved spur configuration.

* * * * *